United States Patent [19]

Tamm et al.

[11] Patent Number: 4,909,267

[45] Date of Patent: Mar. 20, 1990

[54] COOLING PIPE FOR BAR

[75] Inventors: Franz Tamm; Arnold Joachim; Hartmut Blank, all of Hennigsdorf; Bernhard Höricke, Falkensee; Joachim Schulz; Hartmut Richter, both of Hennigsdorf, all of German Democratic Rep.

[73] Assignee: VEB Stahl- und Walzwerk "Wilhelm Florin" , Hennigsdorf, Fed. Rep. of Germany

[21] Appl. No.: 291,709

[22] Filed: Dec. 29, 1988

[30] Foreign Application Priority Data

Jun. 16, 1988 [DD] German Democratic Rep. ..... 3168128

[51] Int. Cl.[4] ..... B08B 3/04

[52] U.S. Cl. ..... 134/122 R; 134/64 R; 134/199; 266/113

[58] Field of Search ..... 134/64 P, 64 R, 122 P, 134/122 R, 199, 200, DIG. 2; 266/113, 111, 112, 114

[56] References Cited

U.S. PATENT DOCUMENTS

| | | | |
|---|---|---|---|
| 2,175,599 | 10/1939 | Finkbone et al. | 134/64 R |
| 2,212,219 | 8/1940 | Wood | 134/64 R X |
| 2,320,499 | 6/1943 | Wood | 134/122 R |
| 3,897,230 | 7/1975 | Taylor et al. | 134/64 R X |
| 4,231,382 | 11/1980 | Beerens | 266/112 X |
| 4,507,949 | 4/1985 | Killilea | 266/112 X |

FOREIGN PATENT DOCUMENTS

| | | | |
|---|---|---|---|
| 1188108 | 3/1965 | Fed. Rep. of Germany | 134/122 R |
| 2556383 | 10/1976 | Fed. Rep. of Germany | 134/64 R |
| 2415151 | 9/1979 | France | 134/64 R |

*Primary Examiner*—Frankie L. Stinson
*Attorney, Agent, or Firm*—Jordan and Hamburg

[57] ABSTRACT

Apparatus for cooling at least two bars travelling in parallel linear paths after having been formed from a larger bar in a rolling mill, comprises a common antechamber for receiving the bars, a cooling water inlet and a cooling water outlet communicating with the antechamber, first and second common nozzle chambers, the first nozzle chamber being arranged for receiving the bars from the antechamber and the second nozzle chamber being arranged for receiving the bars from the first nozzle chamber, each of the nozzle chambers being provided with a respective cooling water inlet communicating with the respective nozzle chamber through a respective equalizing chamber, each of the nozzle chambers containing for each of the bars a respective funnel for guiding the bar and a nozzle for receiving the bar from the funnel, the nozzle having passages for conducting water from the chamber into contact with the bar, communicating with each of the nozzles a respective heat exchanger pipe for receiving a respective one of the bars and cooling water from the nozzle chamber, a common eddy chamber for receiving the bars and cooling water from the heat exchanger pipes, a cooling water outlet communicating with the eddy chamber, and first and second common deflection chambers, the first deflection chamber being arranged for receiving the bars from the eddy chamber and the second deflection chamber being arranged for receiving the bars from the first deflection chamber, each of the deflection chambers being provided with respective means for conducting a fluid deflecting medium into the deflection chamber.

6 Claims, 3 Drawing Sheets

COOLING PIPE FOR BAR

BACKGROUND OF THE INVENTION

The invention relates to a cooling pipe for bar, especially for multiple strands made by the slitting process, wherein the cooling pipe is supplied with water under pressure.

In fine iron rolling mills, slit rolling and split rolling have been used for the purpose of increasing output in rolled materials of small dimensions. By a special gauging method, two shapes of equal cross-sectional area are formed from one bar and finish rolled as individual bars.

As a necessary result, two bars leave a finishing stand close together.

Cooling pipes for cooling bars have been disclosed in the following patents:

| | |
|---|---|
| EP 0 064 771 | PD - A 147 506 |
| DE-OS 16 08 327 | DE-OS 27 27 362 |

A common characteristic of these cooling pipes is that they are all designed for cooling single rolled bars. A variety of methods are used for cooling bars running at close distances apart. In one variant, known cooling pipes, e.g., in accordance with

EP - 0064 771,

DD - A 147 506,

DE - A 1608 327, are disposed as closely together as possible. In this manner bars can be cooled at a distance of about 300 to 400 mm apart.

Since the bars in split rolling usually leave the finish stand at a distance greater than 200 mm apart, this means that at least one bar has to be deflected. If the rolled material has a ribbed surface, e.g., reinforcing bars, and the cooling run is disposed immediately behind the finish stand, this results in great wear in the guiding systems and thus in elevated costs.

In the case of thin dimensions which are produced at higher rolling speeds, these deflections of the bars can be the cause of trouble.

Another variant is that the cooling pipes are staggered. In this manner the required distance between the two rolling lines can be reduced, but the length of the cooling run is doubled.

In another variant according to DE-OS 2727 362, a shorter distance between the bars can be achieved, but this variant entails a very high water consumption, and trouble occurs at higher rolling speeds as a result of excessively high retarding forces in the free pipe cross section. Thus, this variant does not satisfy the operating requirements.

It is inherent in all these systems that each cooling line is provided with a separate water feed and thus changes in the water feed due to various valve settings or leaks lead to different rates of flow and hence to different cooling conditions on the bars, which necessitates greater complication of the controls, such as separate temperature measuring apparatus and the like.

A system is also known for leading both bars in a simple manner through one of the known cooling pipes. In this manner short distances can be used between the bars, yet this procedure does not assure uniform cooling of the surface of the rolled steel to achieve a concentric cooling, and thus it results in warping of the material and ultimately in insufficient quality.

It is an object of the present invention to create a cooling pipe for cooling rolled bars, with which the advantages achieved in split rolling are not limited by the subsequent cooling process, and which will assure a safe guidance of the bar combined with uniform qualities in the cooled bars, and a cooling run of short length.

SUMMARY OF THE INVENTION

According to the invention, there is provided a cooling pipe for cooling rolled bars, especially multiple strands produced by the split rolling method, in which the rolled bars are carried at a distance corresponding to the rolling lines without any substantial deflection therefrom, into a cooling pipe disposed close to the finish rolling stand, which will assure an equal flow of the coolant for each bar.

This object is achieved in accordance with the invention by the fact that the cooling pipe, as seen in the rolling direction, consists of the following units for two bars:

one common antechamber with a water feed for one portion of the cooling water return and with a water outlet, a first and second common nozzle chamber, a separate connection with equalizing chamber for the cooling water feed being provided for each nozzle chamber, separate heat exchanger pipes, a common eddy chamber with a cooling water outlet, a first and second common deflection chamber, a separate inlet for the deflecting medium being provided for each deflection chamber.

The cooling pipe in accordance with the invention is advantageously characterized by the following features:

One inlet funnel is provided at the antechember for each bar.

In each nozzle chamber, guiding funnels and nozzle rings are disposed in the rolling direction for both bars.

Between the separate connections and the nozzle chamber associated with each there is disposed an equalization chamber.

The width B and height H of the equalization chambers are dimensioned, depending on the distance A between bars, according to the equations $B=2A^{+0}-50$ mm; $H=A^{+0}-50$ mm, such that the velocity of flow amounts to no more than 3 m/s.

Double-cone-shaped guiding elements are disposed in the heat exchange pipes.

Guiding funnels and a cooling water outlet are provided in the deflection chamber for the bars.

In each deflection chamber guiding funnels and horizontal deflection plates are disposed for the bars.

With these cooling pipes for separate rolled bars the following advantages are obtained in the cooling:

Due to the common antechambers and eddy chambers, the common nozzle chambers, deflection chambers and equalization chambers, the bars can be cooled at a close distance of between 150 and 200 mm apart.

The equalization chambers assure the same amount of cooling water for both bars.

Since in each nozzle chamber each bar is subjected to the same amount of cooling water, equal cooling conditions are created for each bar.

The separate heat exchanger pipes for each bar assure an equal heat removal on the basis of the equal rate of flow, so that both bars will have the same quality characteristics.

BRIEF DESCRIPTION OF THE DRAWINGS

The invention is to be further explained with the aid of an embodiment, wherein.

Figure 1:
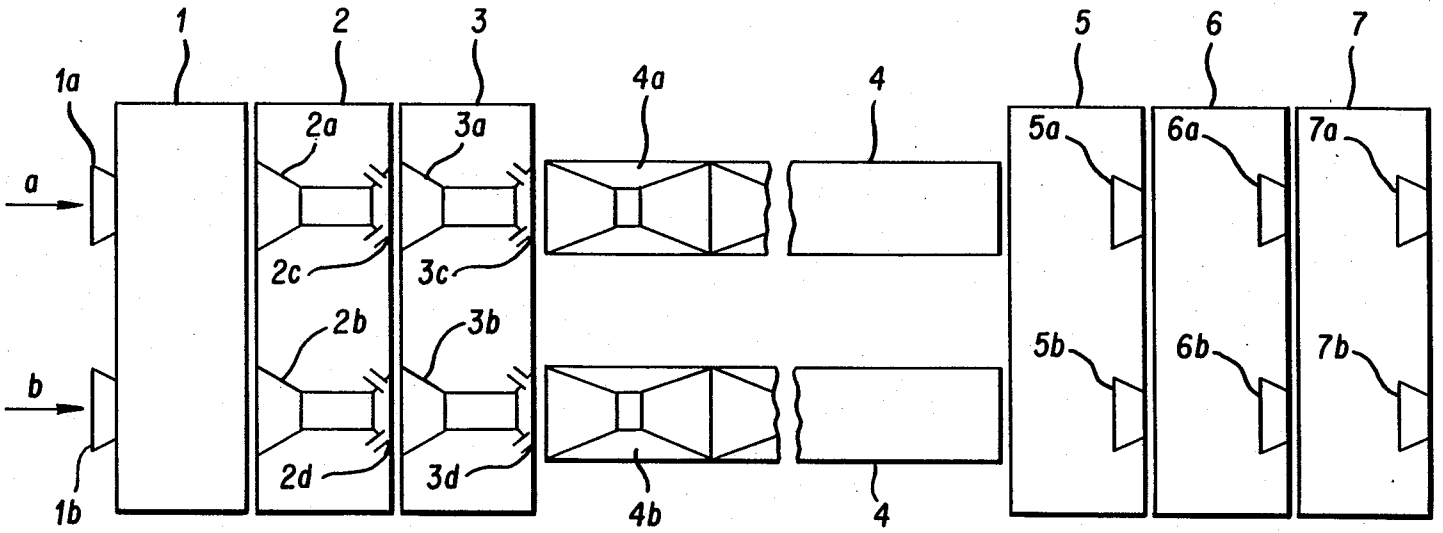
FIG. 1 is a horizontal longitudinal section through a cooling pipe.
Figure 2:
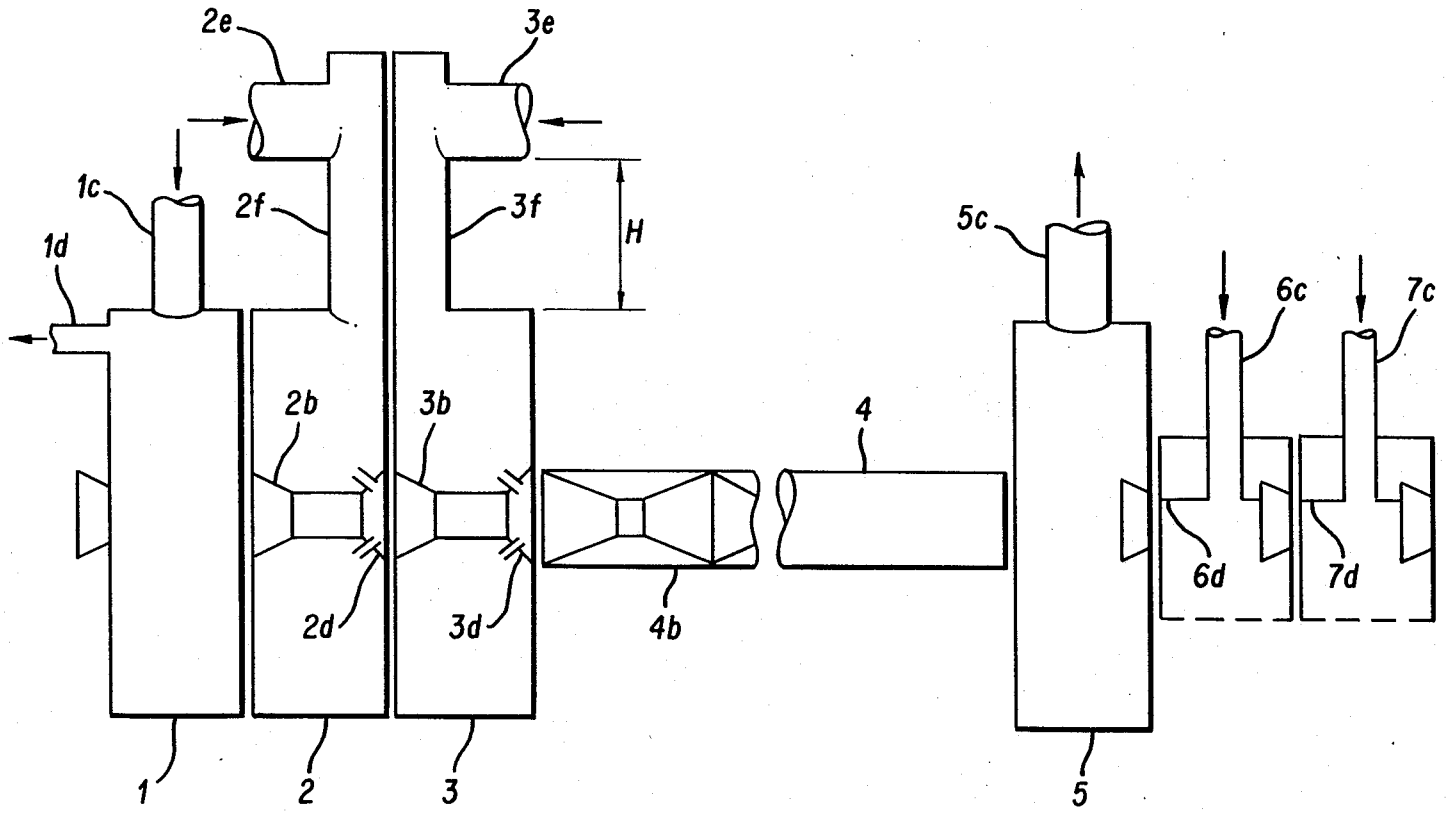
FIG. 2 is a vertical longitudinal section I—I (see FIG. 3) through a cooling pipe.
Figure 3:
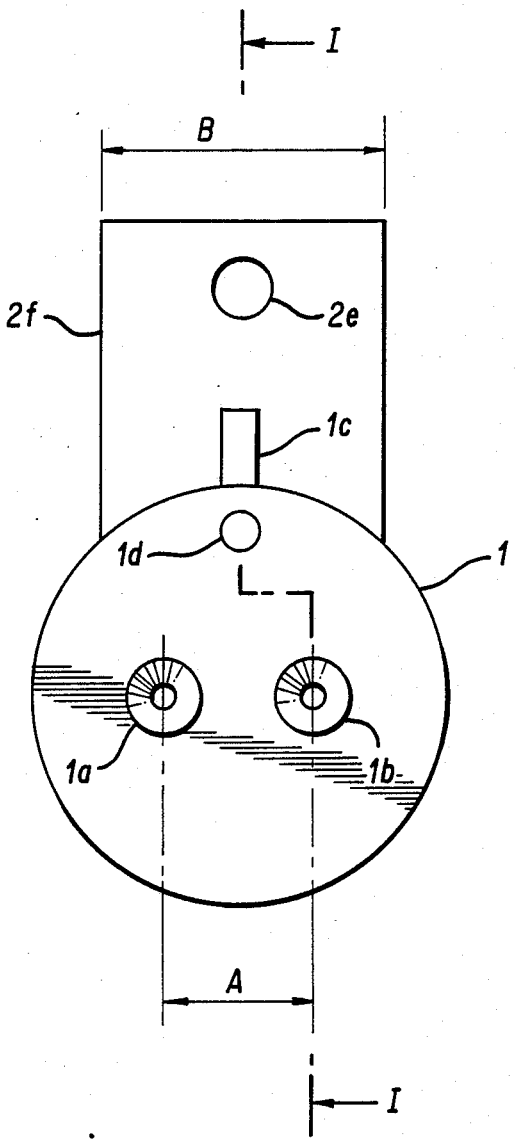
FIG. 3 is a front view of the cooling pipe on which the two bars enter.

The two bars a and b run from the finish stand into the cooling pipe entry funnels 1*a* and 1*b* and from there into an antechamber 1 which is filled through 1*c* by a portion of the cooling water return which is branched off from the cooling water outlet 5*c* of the eddy chamber 5. The excess cooling water is carried out through a water outlet 1*d*. The antechamber 1 is adjoined by the nozzle chambers 2 and 3 into which the cooling water is fed through the connections 2*e* and 3*e*, through the equalization chambers 2*f* and 3*f* to the nozzle rings 2*c*, 2*d* and 3*c*, 3*d*. The guiding funnels 2*a*, 2*b* and 3*a*, 3*b* are provided at the entrance end of the nozzle chambers 2 and 3 to guide the two bars a and b.

The nozzle chambers 3 are adjoined by the separate heat exchanger pipes 4 which are separate for bars a and b and are provided with double conical guide pieces 4*a* and 4*b* in order to increase the turbulence of the cooling water stream and thus the intensity of the heat exchange between cooling water and rolled material.

At the end of the heat exchanger pipes the bars a and b enter into a common eddy chamber 5 by which a portion of the cooling water is carried away through the cooling water outlet 5*c*. The bars a and b pass through the guiding funnels 5*a* and 5*b* into the common deflection chambers 6 and 7, being guided by the guiding funnels 6*a*, 6*b* and 7*a*, 7*b*. The deflecting medium, which can be either water or air, is fed through the inlet 6*c* and 7*c* to the deflection chambers 6 and 7. The deflecting effect is enhanced by the horizontal deflecting plates 6*d* and 7*d* disposed just above the free cross sections.

We claim:

1. Apparatus for cooling at least two bars travelling in parallel linear paths after having been formed from a larger bar in a rolling mill, comprising a common antechamber for receiving the bars, a cooling water inlet and a cooling water outlet communicating with the antechamber, first and second common nozzle chambers, the first nozzle chamber being arranged for receiving the bars from the antechamber and the second nozzle chamber being arranged for receiving the bars from the first nozzle chamber, each of the nozzle chambers being provided with a respective cooling water inlet communicating with the respective nozzle chamber through a respective equalizing chamber, each of the nozzle chambers containing for each of the bars a respective funnel for guiding the bar and a nozzle for receiving the bar from the funnel, the nozzle having passages for conducting water from the chamber into contact with the bar, communicating with each of the nozzles a respective heat exchanger pipe for receiving a respective one of the bars and cooling water from the nozzle chamber, a common eddy chamber for receiving the bars and cooling water from the heat exchanger pipes, a cooling water outlet communicating with the eddy chamber, and first and second common deflection chambers, the first deflection chamber being arranged for receiving the bars from the eddy chamber and the second deflection chamber being arranged for receiving the bars from the first deflection chamber, each of the deflection chambers being provided with respective means for conducting a fluid deflecting medium into the deflection chamber.

2. Apparatus according to claim 1, in which the antechamber is provided with respective entry funnels for conducting each respective one of the bars into the antechamber.

3. Apparatus according to claim 1, in which each of the equalization chambers is of rectangular cross section normal to the direction of flow of cooling water therethrough, the rectangular cross section having a broader dimension B, each of the equalization chambers has a heightwise dimension H measured on the equalization chamber axis normal to the rectangular cross section, the bars are spaced from each other by a bar axis to bar axis distance A, and relationship between B, H and A are defined by the equations $$B=2A_{-50}^{+0}\ \text{mm}$$

and $$H=A_{-50}^{+0}\ \text{mm},$$

so that the flow velocity of cooling water through the equalization chambers is no greater than 3 m/s.

4. Apparatus according to claim 1, in which each of the heat exchanger pipes is provided with a guide for conducting therethrough the respective bar received by the heat exchanger pipe together with cooling water, the guide comprising a conduit in the form of two coaxial hollow frustoconical members connected together at their smaller ends, whereby the guide imparts increased turbulence to cooling water passing therethrough thereby to increase the heat exchange between the respective bar and the cooling water.

5. Apparatus according to claim 1, in which the eddy chamber is provided with respective exit funnels for conducting each respective one of the bars out of the eddy chamber.

6. Apparatus according to claim 1, in which each of the deflection chambers is provided with respective exit funnels for conducting each respective one of the bars out of the deflection chamber and is also provided with deflecting plates in a plane parallel to the axes of the exit funnels and spaced from the axes of the exit funnels a distance approximately equal to the smallest radius of the exit funnels.

* * * * *